US005974990A

United States Patent [19]

Goldbeck et al.

[11] Patent Number: 5,974,990

[45] Date of Patent: Nov. 2, 1999

[54] APPARATUS FOR THE TRANSFER OF A PIPING STRIP FROM A PREPARATION STATION ON TO A WORKPIECE

[75] Inventors: Heinz Goldbeck; Torsten Bochert, both of Bielefeld, Germany

[73] Assignee: Durkopp Adler Aktiengesellschaft, France

[21] Appl. No.: 09/067,300

[22] Filed: Apr. 27, 1998

[30] Foreign Application Priority Data

Apr. 29, 1997 [DE] Germany ..... 197 18 059

[51] Int. Cl.[6] ..... D05B 37/04

[52] U.S. Cl. ..... 112/68

[58] Field of Search ..... 112/68, 129, 70, 112/470.18, 305, 235, 475.09, 475.25

[56] References Cited

U.S. PATENT DOCUMENTS

| | | | |
|---|---|---|---|
| 3,980,030 | 9/1976 | Fisher et al. | 112/470.18 |
| 4,416,204 | 11/1983 | Kaze | 112/68 |
| 4,589,358 | 5/1986 | Goldbeck et al. . | |
| 4,760,808 | 8/1988 | Hulsmann . | |
| 5,085,158 | 2/1992 | Goldbeck et al. . | |
| 5,109,785 | 5/1992 | Inoue et al. | 112/70 X |
| 5,513,585 | 5/1996 | Diekmann et al. | 112/68 |

*Primary Examiner*—Ismael Izaguirre

*Attorney, Agent, or Firm*—Robert F I. Conte; Lee Mann Smith McWilliams Sweeney & Ohlson

[57] ABSTRACT

An apparatus for the transfer of a piping strip from a preparation station on to a workpiece comprises a preparation table and a gripping mechanism to be lowered thereon. In the preparation table, provision is made for a cutting device with a knife carrier having several knives which, by a single knife-driving mechanism, can be elevated from a position lowered underneath the supporting surface of the preparation table and while making cuts, can be guided through the piping strip.

6 Claims, 4 Drawing Sheets

22
19
16
17
20
15
21
89
14
3
18
7
IV
II
29
26
25
56
5
4
4
8
10
10
1
2
6a
6

32
37
38
33
34
80
29
39
43
35
52
36
43
40
48
VIII
55
57
70
67
54
53
68
71
51
50
66
65
25
58
59
49

APPARATUS FOR THE TRANSFER OF A PIPING STRIP FROM A PREPARATION STATION ON TO A WORKPIECE

BACKGROUND OF THE INVENTION

1. Field of the Invention

The invention relates to an apparatus for the transfer of a piping strip from a preparation station on to a workpiece 2. Background Art An apparatus of the generic type is known from U.S. Pat. No. 4,760,808, which comprises a preparation table with a supporting surface for the piping strip. A gripping mechanism is disposed above the preparation table and can be lowered into a working position on the preparation table in which the piping strip is held tight on the supporting surface of the preparation table. Displaceable knives are disposed in the preparation table, which reach beyond the supporting surface and which, when set, cut two collinear slits into the piping strip. Several displacing drives are necessary for the knives; further, a considerable number of components are needed such as knife carriers, bearings and the like.

U.S. Pat. No. 5,085,158 teaches an apparatus for the transfer of a piping strip from a preparation station on to a workpiece, by means of which slits that are also in alignment can be cut in the piping strip. To this end, two knives are disposed within the gripping bar, which are displaceable by separate, pneumatically actuated piston-cylinder drives. A drawback resides in the high number of components such as knife carriers, bearings, driving elements and the like. Two drives are necessary, which displace the individual knives. The high number of components leads to corresponding susceptibility to failure.

SUMMARY OF THE INVENTION

It is the object of the invention to embody an apparatus of the generic type in such a way that it has an especially simple and solid design.

According to the invention, this object is attained in an apparatus for the transfer of a piping strip from a preparation station on to a workpiece, comprising a preparation table, which has a supporting surface for the piping strip; a gripping mechanism disposed above the preparation table, which is movable downwards into a working position on the preparation table, and which is movable upwards into an upper position above the preparation table; a cutting device for cutting at least one slit into the piping strip, which cutting device has a knife carrier, is provided with at least two knives at a distance from each other, and is drivable in such a way that at the beginning of a cutting motion, the knives pass from an initial position through the supporting surface and are then displaced substantially parallel thereto. Due to the fact that only one knife beam is available, which has two or even more knives, the basic construction is very simple (owing to the low number of components), since the mounting and guidance of such a knife beam is not very complicated and can be made rather solid. Further, only a single drive is needed for the displacement of the knife beam and thus for the performance of the cutting motion. Requirements in terms of control are correspondingly low.

Details of the invention will become apparent from the ensuing description of an exemplary embodiment, taken in conjunction with the drawing.

DESCRIPTION OF THE PREFERRED EMBODIMENT

Figure 1:
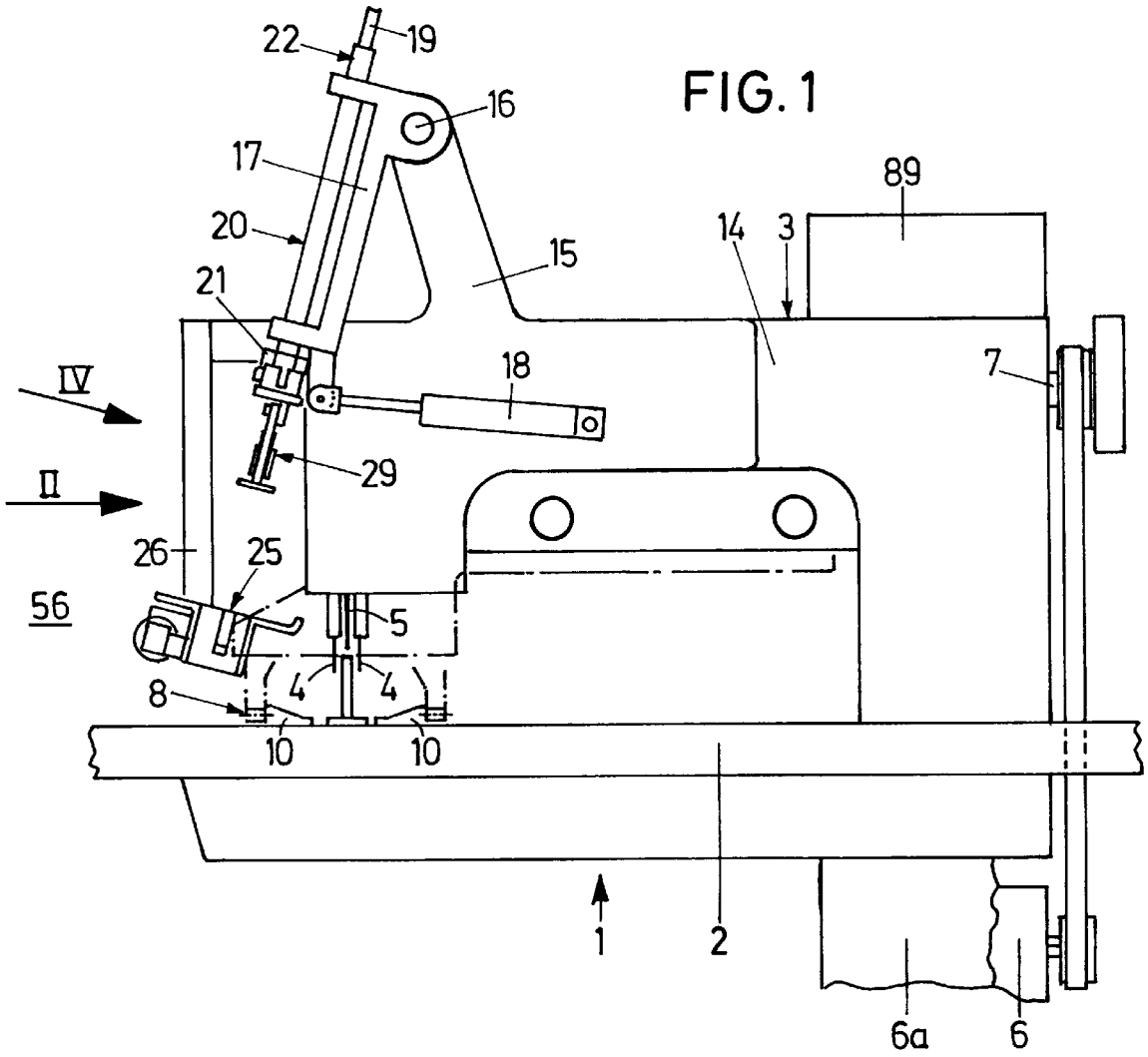
FIG. 1 is a lateral longitudinal view of a sewing machine with a preparation table and a gripping mechanism to be lowered thereon.
Figure 2:
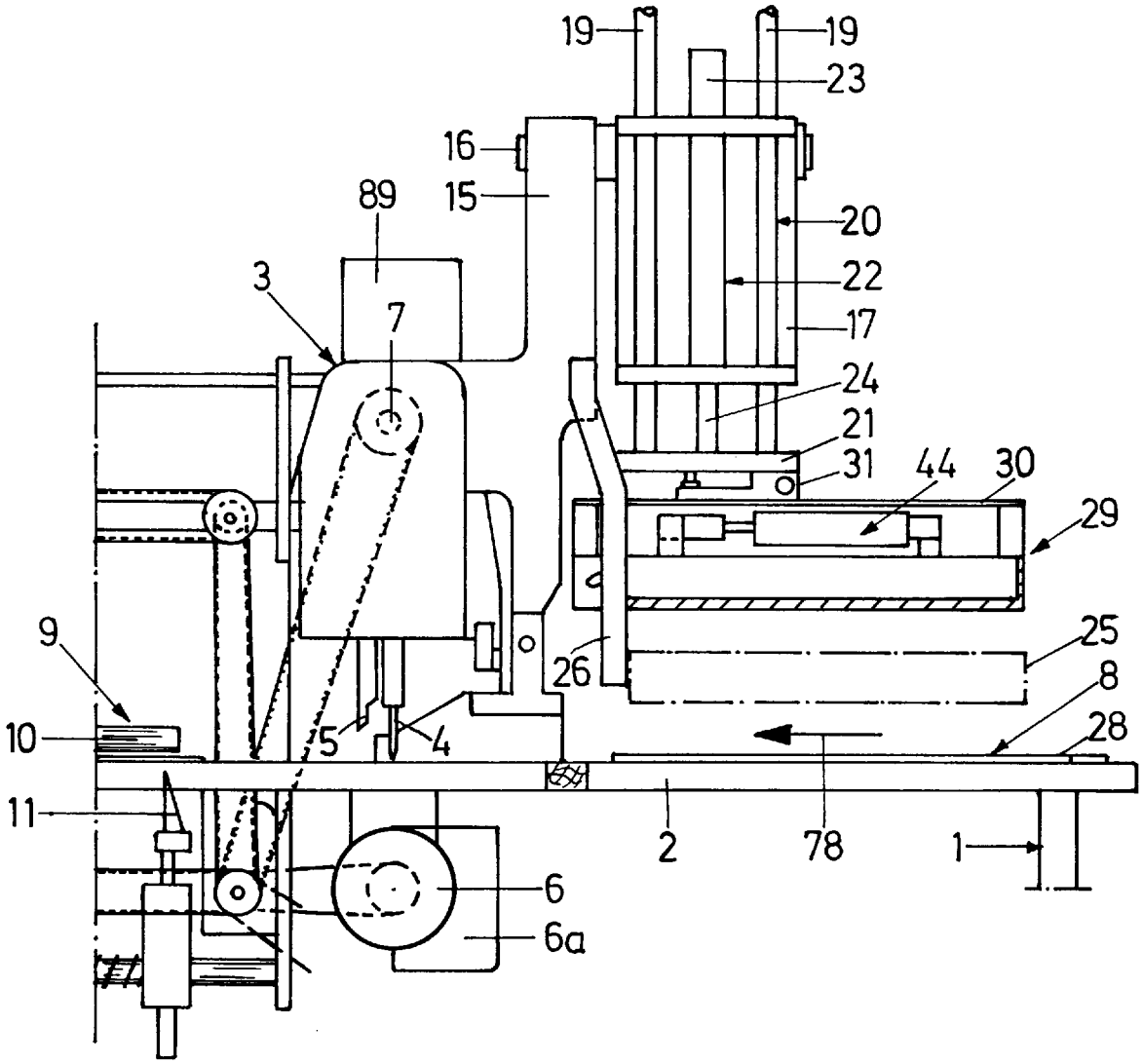
FIG. 2 is a frontal view of the sewing machine in accordance with the arrow II of FIG. 1.
Figure 4:
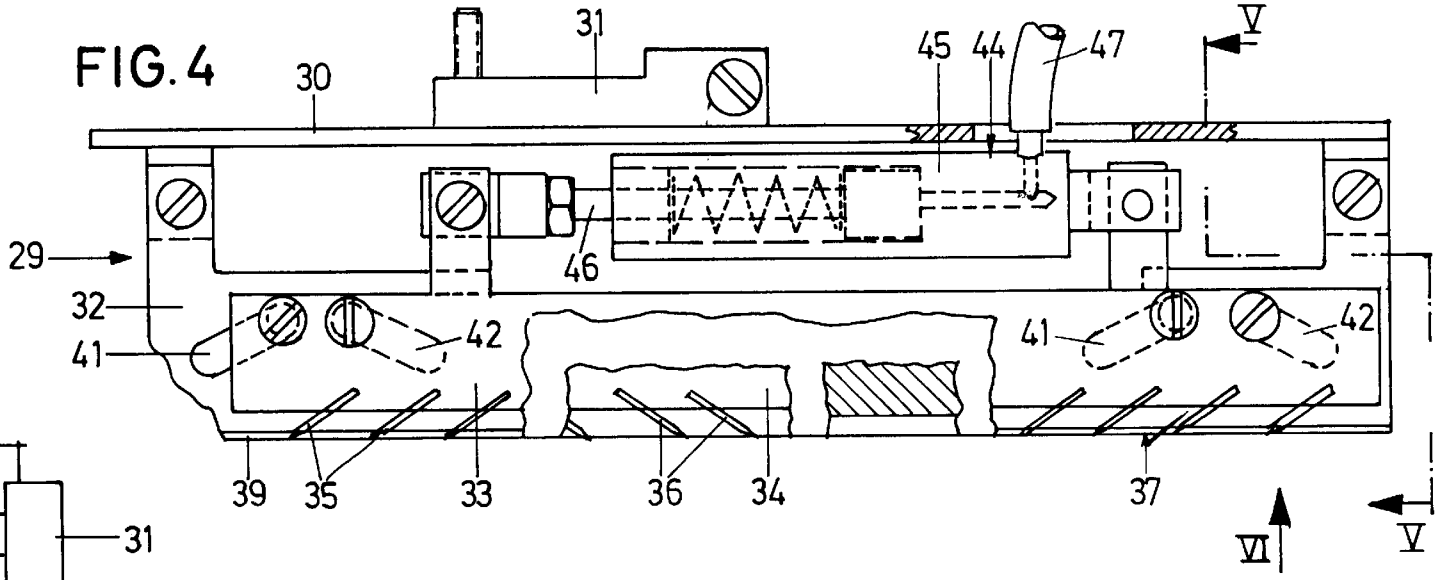
FIG. 4 is a lateral view, on an enlarged scale as compared with FIG. 1, of the gripping mechanism corresponding to the arrow IV of FIG. 1.
Figure 6:
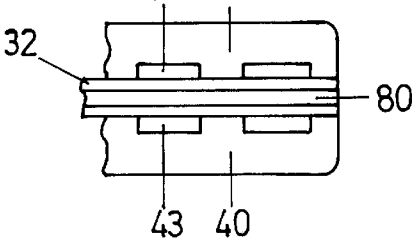
FIG. 6 is a partial view from below of the gripping mechanism in accordance with the arrow VI of FIG. 4.
Figure 7:
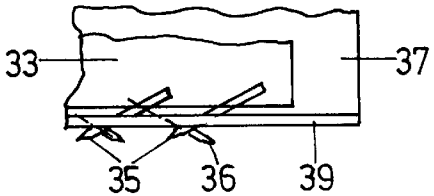
FIG. 7 is a partial illustration of the gripping mechanism corresponding to the illustration of FIG. 4 with the needles extended.
Figure 5:
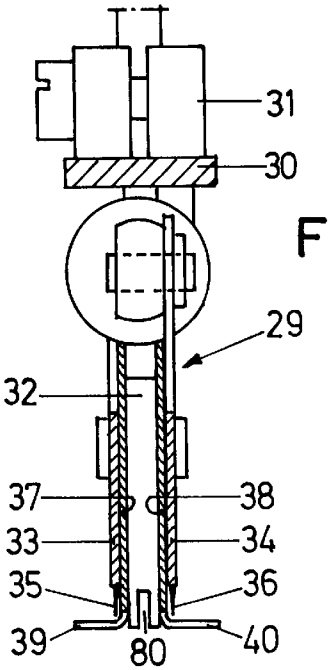
FIG. 5 is a partial sectional view of the gripping mechanism in accordance with the section line V—V of FIG. 4.

The pocket-opening sewing unit seen in FIGS. 1 and 2 comprises a stand 1 with a support plate 2 on which is disposed a two-needle sewing machine 3. In vicinity to, and between, the two sewing needles 4, provision is made for a cutting knife 5 movable up and down for a slit 13 to be cut for a piped pocket opening on a workpiece. In known manner, the cutting knife 5 is connected with a drive assembly to be switched on and off. An arm shaft 7 of the sewing machine 3, a workpiece clamp 10 displaceable between a preparation station 8 and a cutting station 9, and a movable corner cutting knife (not shown) are driven via a common drive 6 which is provided on the underside of the sewing machine 3 and comprises a control unit 6*a*. This corner cutting knife (not shown) and a stationary corner cutting knife 11 serve for the production of comer cuts or angle cuts 12 at each end of the mentioned slit 13 (cf. FIG. 11). The functional interrelationship between the drive 6 and the component parts and subassemblies driven by the latter are generally known in practice and have been illustrated and described in U.S. Pat. No. 4,589,358.

Connected with an arm 14 of the sewing machine 3 is a bearing block 15, the upper portion of which is provided with a bearing journal 16 on which a support 17 is pivotally mounted. A pivot drive 18 in the form of a pneumatically actuated piston-cylinder drive acts on the support 17 on the one hand and on the bearing block 15 on the other, the support 17 being pivoted between two extreme positions by means of this drive 18.

Two parallel guide rods 19 of a guide carriage 20 are displaceably mounted on the support 17 and are connected with each other underneath the support 17 by means of a yoke 21 of the carriage 20.

Above the support plate 2 and in the vicinity of the preparation station 8, provision is made for a preparation table 25 which is fixed to the bearing block 15 by means of a jib 26.

A gripping mechanism in the form of a gripping bar 29, details of which are seen in FIGS. 3 to 7, is mounted on the yoke 21 of the carriage. This gripping bar 29 comprises a support beam 30 which is secured to the yoke 21 of the carriage 20 by means of a fastening device 31. A central support strip 32 is fixed to both ends of the support beam 30; a needle rail 33 and 34, respectively, is attached to the sides of the central support strip 32, the needle rails 33 and 34 on their underside being equipped with needles 35 and 36, respectively, that are oblique and extend towards each other. Angled strips 37 and 38, respectively, are mounted on the support beam 30 and on the support strip 32, respectively, the elbows 39, 40 of which stand out freely and are disposed in a common plane. The needle rails 33 and 34, respectively, are displaceably guided in oblique guides 41 and 42, respectively, which are allocated to each other by twos and formed by oblong holes and bolts passing through the latter. Thus, the needle rails 33, 34 are displaceable such that when in an extreme position illustrated in FIG. 4, they have needles 35, 36 retracted upwards into the gripping bar 29, while when in the other extreme position—according to FIG. 7—they have needles 35, 36 extended downwards under the elbows 39, 40. To this end, the elbows 39, 40 that stand out are provided with recesses 43 allocated to the needles 35, 36. For the needle rails 33, 34 to be correspondingly driven, a gripping drive 44 is provided, which is a pneumatically actuated piston-cylinder drive and the two ends of which are articulated to the needle rails 33, 34. The cylinder 45 is articulated to the needle rail 33, while the piston rod 46 is articulated to the other needle rail 34. The cylinder 45 is connected to a compressed air source via a compressed air supply 47. With the piston rod 46 retracted into the cylinder 45, the needle rails 33, 34 are in their upper position, i.e. the needles 35, 36 are retracted into the gripping bar 29. As opposed to this, the needle rails 33, 34 are displaced at an angle downwards when the piston rod 46 is extended out of the cylinder 45, whereby the needles 35, 36 are extracted through the recesses 43 downwards for the piping strip 48 to be gripped.

The unit described so far is known in practice and has been illustrated and described in U.S. Pat. No. 5,085,158. According to this known design, two needle rails displaceable in opposite directions and provided with needles arranged in opposite directions can be provided on each side of the central support strip.

The structure of the preparation table 25 will become apparent from FIGS. 3 and 8 to 10. Accordingly, the preparation table 25 comprises a horizontal preparation-table support 49 which is provided with an elongated guide recess 50 which is open towards the gripping bar 29 and in which a knife carrier 51 in the form of a knife beam is guided for displacement in the longitudinal direction and towards the gripping bar 29. Angular partial table-tops 52, 53 are screwed to the side of the support 49, combining with the support 49 to form a supporting surface 54 for the piping strip 48. On both sides of the recess 50 and underneath the needles 35, 36, resilient pads 55, for instance of expanded rubber, are provided in the support 49, into which the needles 35, 36 can stitch in their extended position. The partial table-top 52 is provided with a lay edge 57 for the piping strip 48.

Figure 8:
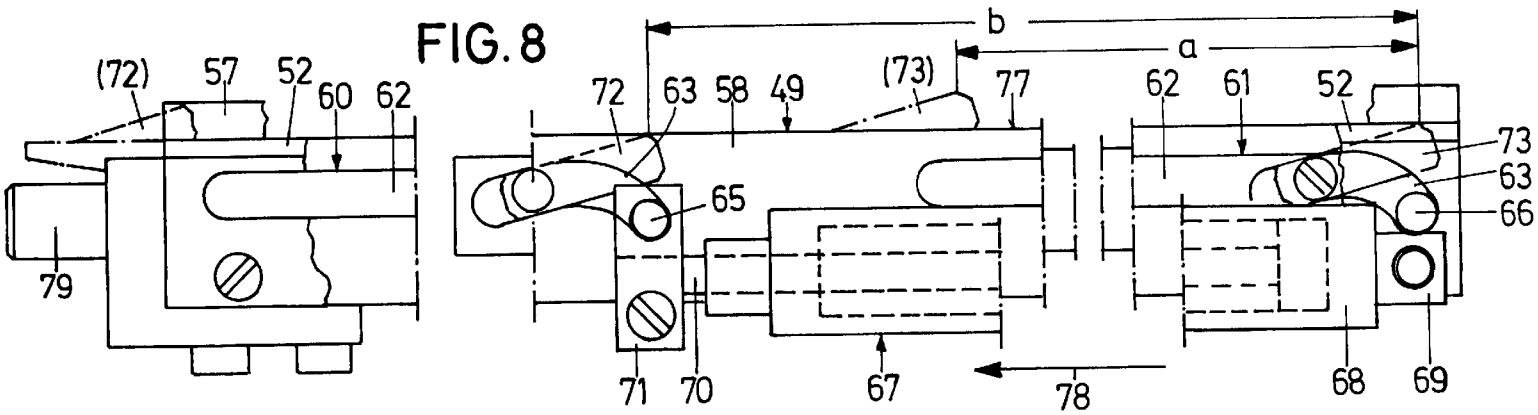
FIG. 8 is a lateral longitudinal view of the preparation table corresponding to the arrow VIII of FIG. 3 in an illustration partially broken off.

Two pairs of curved paths 60, 61 are formed at a distance from each other in each of the two legs 58, 59, defining the recess 50, of the support 49. These curved paths 60, 61 have a main guide section 62 which is parallel to the supporting surface 54. At their respective beginning, the curved paths 60, 61 are provided with initial guide sections 63 that are curved downwards from the supporting surface 54. The knife carrier 51 is provided with two drilled holes 64 through which bolts 65, 66 are passed which are moreover disposed in the curved paths 60, 61. The bolt 66 is guided against axial displacement between the partial table-tops 52, 53. The allocation of the bolts 65, 66 is such that both bolts 65, 66 are simultaneously at the beginning of the initial guide sections 63 of the curved paths 60, 61, as seen in FIG. 8. In the case of displacement of the knife carrier 51 in its longitudinal direction, it is lifted parallel to itself in the direction towards the supporting surface 54 due to the shaping of the initial guide sections 63 and is then displaced in the main guide sections 62 in parallel to the supporting surface 54. The displacement takes place by means of a knife-driving mechanism 67 which is a pneumatically actuated piston-cylinder drive. The cylinder 68 is mounted on the support 49 by means of a joint 69. The piston rod 70 is connected with the bolt 65 by means of a clamped joint 71, whereby extraction motions of the piston rod 70 out of the cylinder 69 are translated into the described lifting and displacing motion of the knife carrier 51.

Figure 9:
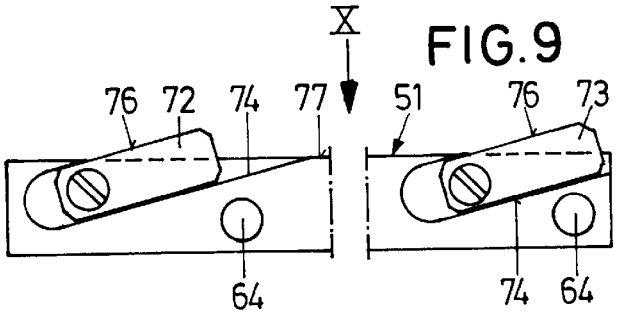
FIG. 9 is an illustration, corresponding to that of FIG. 8, of a knife carrier.
Figure 10:
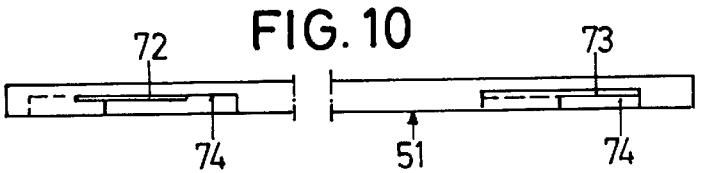
FIG. 10 is a plan view of the knife carrier corresponding to the arrow X of FIG. 9.

In the embodiment according to FIGS. 8 to 10, the knife carrier 51 is provided with two knives 72, 73 which are replaceably fixed by screws 75 in recesses 74 of the knife carrier 51. The knives 72, 73 project by their cutting edges 76 beyond the surface 77 of the knife carrier 51 and are set slightly obliquely towards the cutting direction 78 so that a drawing cut is produced.

At its end turned towards the jib 26, the preparation-table support 49 is provided with a retaining pin 79 which is held in the jib 26 by means of a clamp (not shown), whereby the preparation table 25 can be adjusted accurately.

In the central support strip 32 of the gripping bar 29, a groove 80 is formed, which is adapted to the motion of the knife carrier and into which reach the cutting edges 76 of the knives 72, 73 when cutting.

Figure 3:
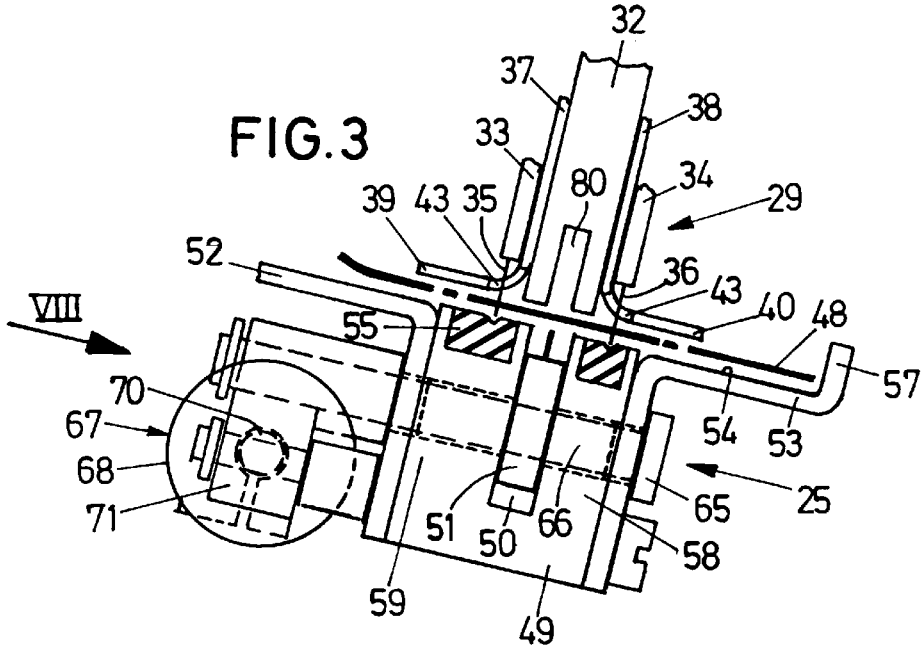
FIG. 3 is an illustration, on an enlarged scale as compared with FIG. 1, of the preparation table having a cutting device with the gripping mechanism lowered on to the preparation table.

The operating sequence is as follows:

In the initial position, the gripping bar 29 is in the elevated position above the preparation table 25 seen in FIG. 1. The needles 35, 36 are retracted, i.e. they do not project downwards over the elbows 39, 40. The knife carrier 51 is in the position seen in FIG. 8, in which the knives 72, 73 are completely immersed by their cutting edges 76 in the guide recess 50 of the preparation table 49. The knives 72, 73 are below the supporting surface 54 for the piping strip 48 (FIG. 3).

In this initial position of the various functional parts, a piping strip 48, which is formed by an approximately rectangular strip of fabric, is placed on the preparation table 25, one of its edges being applied to the lay edge 57. Then the gripping bar 29 is moved downwards on to the preparation table 25 by actuation of the linear drive 22, the piping strip 48 thus being fixed between the elbows 39, 40 on the one hand and the supporting surface 54 on the other. By actuation of the gripping drive 44, i.e. by extraction of the latter's piston rod 46, the needle rails 33, 34 are moved apart and at an angle downwards, whereby the needles 35, 36 stitch at an angle from above into the piping strip 48. In doing so, the needles 35, 36 stitch into the expanded rubber pads 55. The piping strip 48 is needled and thus held tight.

Figure 11:
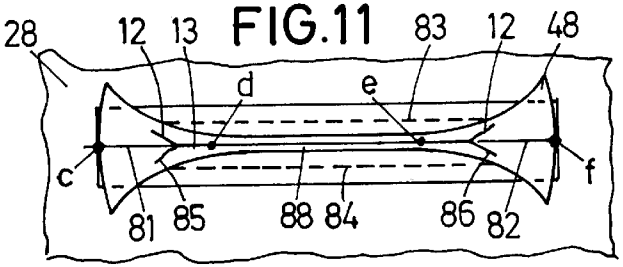
FIG. 11 is a plan view of a piping strip sewn on a workpiece inclusive of all the cuts made.

Subsequently, compressed air is admitted to the knife-driving mechanism 67 so that its piston rod 70 extends. Upon the displacement, the knife carrier 51 with the knives 72, 73 is lifted by the bent initial guide sections 63 extending towards the supporting surface 54 and is then displaced parallel to the supporting surface. FIG. 8 illustrates the displaced position of the knife carrier 51 with the knives 72, 73 by dot-dashed lines. Correspondingly, the knives 72, 73 are denoted here as knives (72), (73). Upon the lifting motion in the initial guide sections 63, the knives 72, 73 start cutting two slits 81, 82 into the piping strip 48 which are in alignment one after the other in the cutting direction 78. As seen in FIG. 11, the slit 81 extends from the point c to the point d and the slit 82 from the point e to the point f. Once these slits 81, 82 have been produced, the knife carrier 51 with the knives 72, 73 is moved back into its initial position; the gripping bar 29 is moved upwards into its initial position together with the cut piping strip 48, it being moved for further processing into a vertical position over the preparation station 8 disposed upstream of the sewing machine 3 by simultaneous actuation of the pivot drive 18. There, the piping strip 48 is placed on a workpiece 28 positioned on the support plate 2 and treated in known manner.

After being folded, the piping strip 48 and the workpiece 28 positioned below it are guided by means of the workpiece clamp 10 through the sewing machine 3 and connected with each other by seams 83, 84 produced on both sides of the slits 81, 82. By the cutting knife 5 being switched on and off in accurate timing, a cut 88 is produced between the seams 83, 84, the starting point of which finds itself between the points c and d and the end point of which is between the points e and f. Then the corner-cutting knives 11 mentioned above are triggered and two angular corner cuts 85, 86 are produced. The final product is illustrated in FIG. 11. As the production of the seams 83, 84 proceeds, the piping strip 48 is pulled off the gripping bar 29 so that the latter can again be elevated and moved into its initial position over the preparation table 25. Another piping strip 48 can be placed on the preparation table 25. Triggering the workpiece clamp 10 with the workpieces 48, 28 of the sewing machine 3 and the mentioned cutting devices takes place in coordination by a control unit 89.

Figure 12:
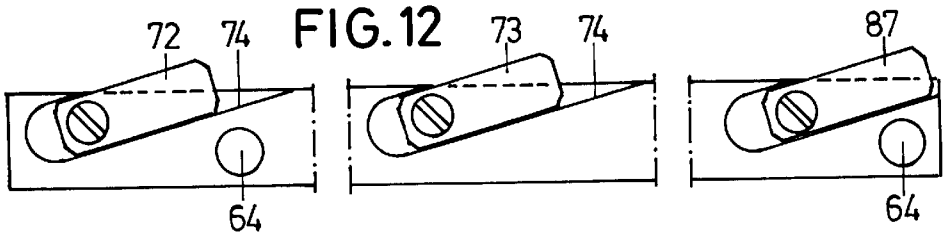
FIG. 12 is a lateral longitudinal view of a modified embodiment of a knife carrier in an illustration corresponding to FIG. 9.

When the displacement path a of the knives 72 73 in their cutting position is greater than the distance b they have from each other, then the slits 81, 82 pass into each other, i.e. form a continuous slit. As seen in FIG. 12, several knives, for instance the knives 72, 73, 87, can be arranged on a knife carrier 51', in which case three cuts are made simultaneously. The displacement path of the knife carrier 51' can then be correspondingly shorter, which results in constructional simplification of the knife-driving mechanism 64 and in a prolonged punching time of the knives 72, 73, 87.

What is claimed is:

1. An apparatus for the transfer of a piping strip (48) from a preparation station (8) on to a workpiece (28), comprising a preparation table (25),
which has a supporting surface (54) for the piping strip (48),
a gripping mechanism (29) disposed above the preparation table (25), which
is movable downwards into a working position on the preparation table (25), and which
is movable upwards into an upper position above the preparation table (25), a cutting device for cutting at least one slit (81, 82) into the piping strip (48), which cutting device
has a single knife carrier (51, 51'), which
is provided with at least two knives (72, 73, 87) at a constant distance (b) from each other,
is displaceably guided parallel to itself, and
is drivable by a single linear drive (62) in such a way that at the beginning of a cutting motion, the knives (72, 73, 87) pass from an initial position through the supporting surface (54) and are then displaced substantially parallel to the supporting surface (54).

2. An apparatus according to claim 1, wherein the cutting device is disposed in the preparation table (25).

3. An apparatus according to claim 2, wherein the initial position is located underneath the supporting surface (54).

4. An apparatus according to claim 1, wherein the knife carrier (51; 51') is displaceably guided in a guide recess (50) of a support (49).

5. An apparatus according to claim 1, wherein the knife carrier (51; 51') is displaceably guided in curved paths (60, 61).

6. An apparatus according to claim 5, wherein the knife carrier (51; 51') is displaceably guided in a guide recess (50) of a support (49) and wherein the curved paths (60, 61) are formed in the support (49).

* * * * *